US006339402B1

(12) United States Patent
McKivergan

(10) Patent No.: US 6,339,402 B1
(45) Date of Patent: Jan. 15, 2002

(54) LOW PROFILE TUNABLE CIRCULARLY POLARIZED ANTENNA

(75) Inventor: Patrick D. McKivergan, Scotts Valley, CA (US)

(73) Assignee: Rangestar Wireless, Inc., Aptos, CA (US)

( * ) Notice: Subject to any disclaimer, the term of this patent is extended or adjusted under 35 U.S.C. 154(b) by 0 days.

(21) Appl. No.: 09/746,570

(22) Filed: Dec. 21, 2000

Related U.S. Application Data

(60) Provisional application No. 60/171,765, filed on Dec. 22, 1999.

(51) Int. Cl.[7] ..... H01Q 1/24
(52) U.S. Cl. ..... 343/702; 343/700 MS
(58) Field of Search ..... 343/702, 700 MS, 343/846, 745, 749; H01Q 1/24, 1/38

(56) References Cited

U.S. PATENT DOCUMENTS 5,550,554 A * 8/1996 Erkocevic ..... 343/828
5,644,319 A * 7/1997 Chen et al. ..... 343/702
5,966,097 A * 10/1999 Fukasawa et al. ... 343/700 MS

* cited by examiner

*Primary Examiner*—Hoanganh Le
(74) *Attorney, Agent, or Firm*—Fulbright & Jaworski L.L.P.

(57) ABSTRACT

An antenna assembly for a wireless communication device. The antenna assembly is mountable onto a printed wiring board (PWB) and consists of first and second conducting elements. The first conducting element is capacitively coupled via a matchable shunt and operatively connected to a ground plane of the PWB, while the second conducting element is operatively connected to the ground plane of the PWB at two locations. The first and second conducting elements are operatively connected to each other by a tunable bridge capacitor and together form two orthogonal magnetic dipole elements. The antenna assembly provides substantially circular hemispherical polarization over a wide range of amplitudes by virtue of the geometry and orientation of the two magnetic dipole elements which are fed with equal amplitude, but in-phase quadrature. The matchable shunt acts as an impedance transformer to yield a low voltage standing wave ratio (VSWR) of less than two-to-one at the operating frequency. The antenna assembly includes a single feed point which permits RF energy to be distributed to both conducting elements without a power splitter or phase shifter(s).

26 Claims, 6 Drawing Sheets

LOW PROFILE TUNABLE CIRCULARLY POLARIZED ANTENNA

This application claims the benefit of U.S. Provisional Application No. 60/171,765 filed Dec. 22, 1999.

FIELD OF THE INVENTION

The present invention relates to an antenna assembly suitable for wireless transmission of analog and/or digital data, and more particularly to an antenna assembly for providing a conformal circularly polarized antenna.

BACKGROUND OF THE INVENTION

Recent advances in wireless communications devices have renewed interest in antennas suitable for such systems. Several factors are usually considered in selecting an antenna for a wireless telecommunications device. Significant among these factors are the size, the bandwidth, and the radiation pattern of the antenna.

Currently, monopole antennas, patch antennas and helical antennas are among the various types of antennas being used in wireless communications devices. These antennas, however, have several disadvantages, such as limited bandwidth and large size. Also, these antennas exhibit significant reduction in gain at lower elevation angles (for example, 10 degrees), which makes them undesirable in some applications.

One type of antenna is an external half wave single or multi-band dipole. This antenna typically extends or is extensible from the body of a wireless communication device in a linear fashion. Because of the physical configuration of this type of antenna, electromagnetic waves radiate equally toward and away from a user. Thus, there is essentially no front-to-back ratio and little or no specific absorption rate (SAR) reduction. With multi-band versions of this type of antenna, resonances are achieved through the use of inductor-capacitor (LC) traps. With this antenna, gains of +2 dBi are common. While this type of antenna is acceptable in some wireless communication devices, it has drawbacks. One significant drawback is that the antenna is external to the body of the communication device. This places the antenna in an exposed position where it may be accidentally or deliberately damaged.

A related antenna is an external quarter wave single or multi-band asymmetric wire dipole. This antenna operates much like the aforementioned antenna, but requires an additional quarter wave conductor to produce additional resonances. This type of antenna has drawbacks similar to the aforementioned antenna.

Yet another type of antenna is a Planar Inverted F Antenna (PIFA). A PIFA derives its name from its resemblance to the letter "F" and typically includes various layers of rigid materials formed together to provide a radiating element having a conductive path therein. The various layers and components of a PIFA are typically mounted directly on a molded plastic or sheet metal support structure. Because of their rigidity, PIFAs are somewhat difficult to bend and form into a final shape for placement within the small confines of radiotelephones. In addition, PIFAs may be susceptible to damage when devices within which they are installed are subjected to impact forces. Impact forces may cause the various layers of a PIFA to crack, which may hinder operation or even cause failure. Various stamping, bending and etching steps may be required to manufacture a PIFA because of their generally non-planar configuration. Consequently, manufacturing and assembly is typically performed in a batch-type process which may be somewhat expensive. In addition, PIFAs typically utilize a shielded signal feed, such as a coaxial cable, to connect the PIFA with the RF circuitry within a radiotelephone. During assembly of a radiotelephone, the shielded signal feed between the RF circuitry and the PIFA typically involves manual installation, which may increase the cost of radiotelephone manufacturing.

SUMMARY OF THE INVENTION

An antenna assembly for a wireless communications device. The antenna assembly is mountable onto a printed wiring board (PWB) and consists of first and second conducting elements. The first conducting element is both capacitively coupled via a matchable shunt and operatively connected to a ground plane of the PWB, while the second conducting element is operatively connected to the ground plane of the PWB at two locations. The first and second conducting elements are operatively connected to each other by a tunable bridge capacitor to form orthogonal magnetic dipole elements. The antenna assembly provides substantially circular polarization within a hemisphere by virtue of the geometry and orientation of the two magnetic dipole elements which are fed with equal amplitude, but in-phase quadrature. The matchable shunt acts as an impedance transformer to yield a low voltage standing wave ratio (VSWR) of less than two-to-one at the operating frequency. The antenna assembly includes a single feed point which is capacitively coupled to and in parallel with the matchable shunt to ensure that the magnet dipole elements do not present a direct current (DC) ground to any radio frequency (RF) circuit connected to the antenna assembly. The single feed point permits RF energy to be distributed to both conducting elements without a required power splitter or phase shifter(s).

It is an object of the present invention to provide an antenna assembly which may be incorporated into a wireless communication device.

It is another object of the present invention to provide polarization diversity which can enhance radio performance in multipath environments, such as inside buildings or within metro areas.

It is yet another object of the present invention to provide frequency agility by adjusting the value of a bridge capacitor.

It is a further object of the present invention to enhance operation of an antenna assembly over a range of frequencies.

A feature of the present invention is the provision of orthogonally oriented magnetic dipole elements.

Another feature of the present invention is that there is a single feed point for radio frequencies.

Another feature of the present invention is that the antenna assembly is tunable over a range of frequencies.

An advantage of the present invention is that the antenna assembly has a low profile which enables it to be used in small articles such as wireless communication devices.

Another advantage of the present invention is that various components of a transciever device may be positioned within interior regions of the antenna assembly to reduce the overall size of the electronic device.

These and other objects, features and advantages will become apparent in light of the following detailed description of the preferred embodiments in connection with the drawings.

DETAILED DESCRIPTION OF THE PREFERRED EMBODIMENTS

Figure 1:
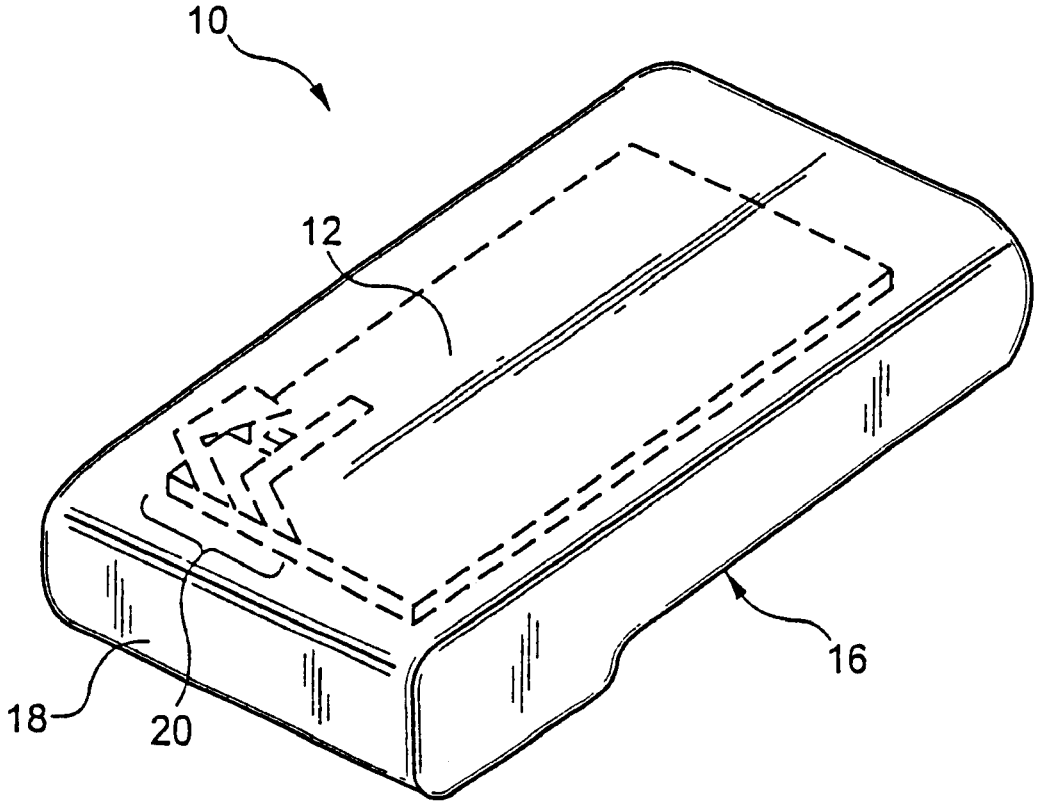
FIG. 1 is a perspective view of a wireless communication device incorporating an antenna assembly according to the present invention.

Referring now to the drawings, wherein like numerals depict like parts throughout, FIG. 1 illustrates a wireless communications device 10, such as a cellular telephone, utilizing an antennas assembly 20 according to the present invention. As depicted, the antenna assembly 20 is disposed at an upper corner of a printed wiring board (PWB) 12 which, in turn, is positioned so that the antenna assembly is adjacent the top 18 and projects away from the front surface 16 of the wireless communications device 10.

Figure 2:
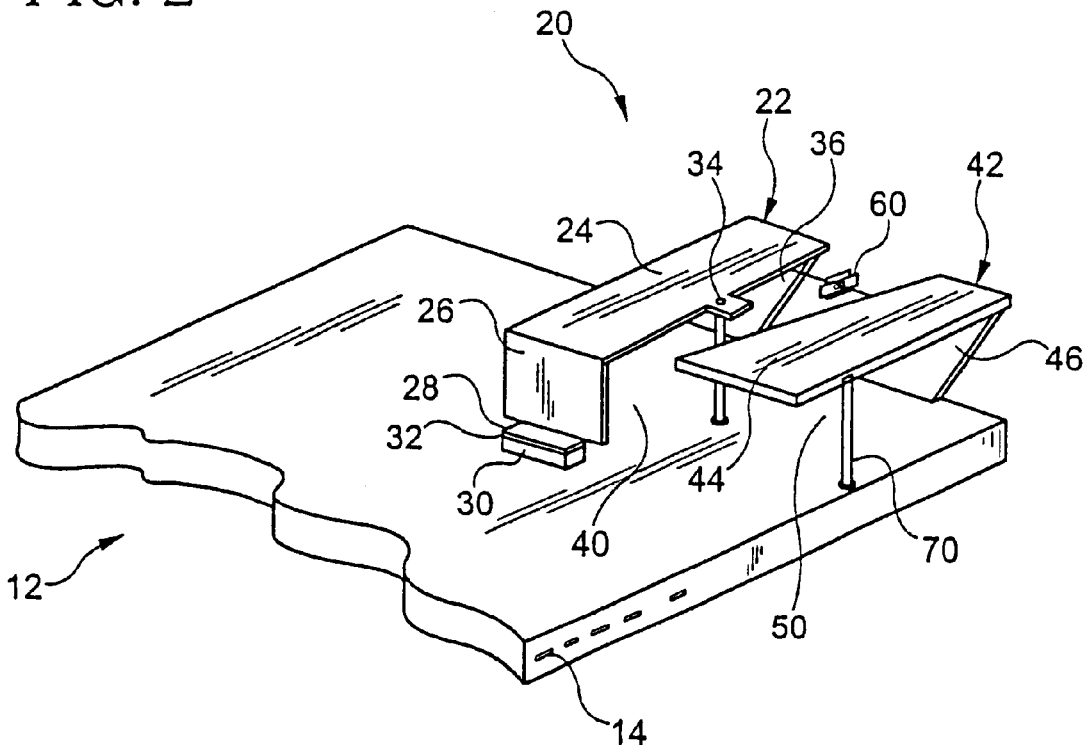
FIG. 2 is a fragmentary perspective view of the antenna assembly according to the present invention.

As depicted in FIG. 2, the antenna assembly 20 is comprised of two main portions, a first conducting element 22 and a second conducting element 42. The first conducting element 22 includes a first conductive surface 24 which is coupled at two regions to ground plane 14 of the printed wiring board 12 by first and second leg elements 26, 36. The first leg element 26 extends between the first conductive surface 24 and the ground plane 14 in a generally orthogonal orientation. The leg element 26 includes a foot 28. Dielectric element 30 is disposed between the foot 28 and the ground plane 14. Together foot 28, dielectric element 30 and ground plane 14 form a shunt matching capacitor 32. Shunt capacitor 32 could alternatively be a discrete capacitor coupled between the ground plane 14 and the leg element 26. For GPS frequencies (1575 MHz), the shunt matching capacitor has a capacitance value of around 1.0 pF.

Figure 4:
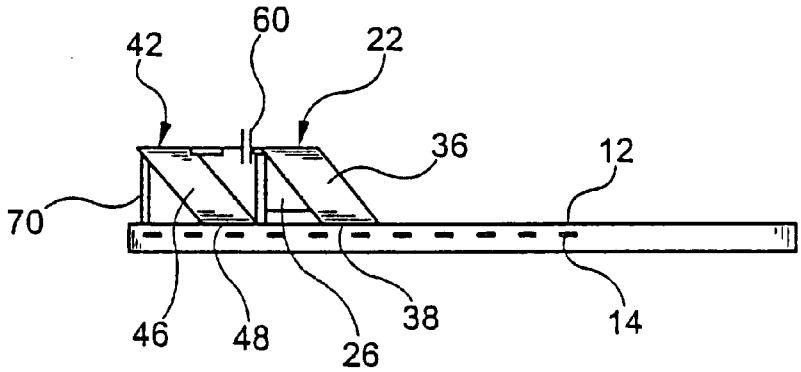
FIG. 4 is a an end view of the antenna assembly according to the present invention.

The second leg element 36 extends between and operatively connects the first conductive surface 24 and the ground plane 14. In the preferred embodiment, and as best depicted in FIG. 4, the second leg element 36 is diagonally oriented with respect to the conductive surface 24 and the ground plane 14. The diagonal orientation of the second leg element 36 may be varied depending on the particular application, e.g., a different device housing, etc. Together, the first and second leg elements 26, 36 position the first conductive surface 24 of the first conducting element 22 at a predetermined distance or spaced relation from the ground plane 14 of the printed wiring board 12. Note that in doing so, an interior region 40 is defined. This interior region 40 may be used to receive various components of the wireless communication device to form a more compact structure.

The conductive surface 24 also includes a feed point 34 which is coextensive with the plane of the first conductive element 24 and which extends away therefrom towards the second conductive surface 44 of the second conducting element 42. The feed point 34 is operatively connected via a conductive post or other conductor to a radio frequency (RF) signal connection or port on the printed wiring board 12. Preferably, the feed point 34 is capacitively coupled to ensure that the magnetic dipole elements do not present a DC ground to any RF circuit connected thereto. In operation, RF energy is distributed to both of the conducting elements 22, 42 without the need of a power splitter of phase shifter(s).

The second conducting element 42 includes a second conductive surface 44 which is operatively connected at two points to ground plane 14 of the printed wiring board 12 by a leg element 46 and a conducting member 70. In the preferred embodiment and as best depicted in FIG. 4, leg element 46 is diagonally oriented with respect to the conductive surface 44 and the ground plane 14. The leg element 46 positions the second conductive surface 44 of the second conducting element 42 a predetermined distance or spaced relation from the ground plane 14 of the printed wiring board 12. Note that in positioning the second conductive surface 44 a predetermined distance from the ground plane 14, an interior region 50 is defined as illustrated in FIG. 2. As with the interior region 40, this interior region 50 may be used to house various components of the wireless communication device to form a more compact structure.

The second conducting element 42 is also operatively connected to the ground plane 14 by a conductive connecting member 70 and forms one of the electromagnetic dipole elements.

The connecting member 70 may be located at other locations, however, as will be appreciated by one skilled in the arts this may alter the operating characteristics of the antenna assembly as a whole.

As can be seen, the first and second conductive surfaces 24, 44 of the first and second conducting elements 22, 42 are capacitively coupled to each other by a bridge capacitor 60. The bridge capacitor 60 has a tuning range of ±30%. For GPS frequency operation, the bridge capacitor has a capacitance value of around 0.65 pF and an adjustable range of around 0.3–0.9 pF to yield the aforementioned ±30% bandwidth.

Figure 3:
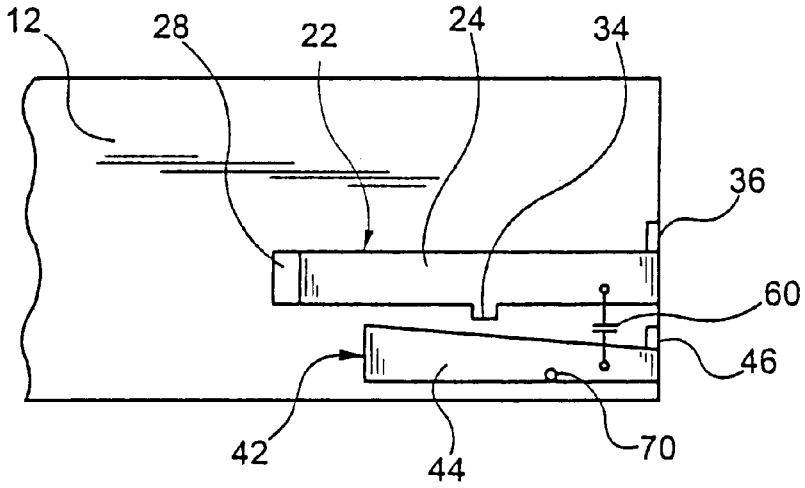
FIG. 3 is a fragmentary top plan view of the antenna assembly according to the present invention.

Referring now to FIGS. 3 and 4, it can be seen that the first conductive surface 24 is generally rectangular and substantially planar. However, the first conductive surface 24 may assume other configurations. For example, they could trapezoidal, circular, etc. ; or they may have different thicknesses; or they may be non-planar; or the feed point may be angled and/or non-aligned with the first conductive surface.

As seen in FIG. 2, the first leg element 26 includes a foot 28 which is adjacent a dielectric element 30, with the foot 28, dielectric element 30 and the ground plane 14 forming a shunt matching capacitor 32. The dielectric element 30 is of conventional material having a dielectric constant of between 1.0 and 1.0, and preferably around 3.0. The shunt matching capacitor 32 acts as an impedance transformer to yield a low voltage standing wave ratio (less than 2:1) at the operating frequency (1575.42 MHz). Alternative capacitor structures or types may also be appreciated.

As illustrated in FIG. 4, the second leg element 36 of the first conducting element 22 extends generally diagonally in a plane perpendicular to the ground plane 14 to an attachment point 38 located at a corner portion of the printed wiring board 12.

The second conductive surface 44 of the second conducting element 42 is positioned a predetermined distance from the first conductive surface 24 so that there is a gap therebetween. Preferably, the second conductive surface 44 is trapezoidal, planar and aligned with the first conductive surface 24, as shown in FIGS. 2 and 3. However, the second conductive surface 44 may assume other configurations as discussed above for the first conductive surface 24.

Again referring to FIG. 4, and as with the second leg element 36 of the first conducting element 22, the leg element 46 of the second conducting element 42 extends generally diagonally in a plane perpendicular to the ground plane 14 to an attachment point 48 located at a corner portion of the printed wiring board 12.

Figure 5:
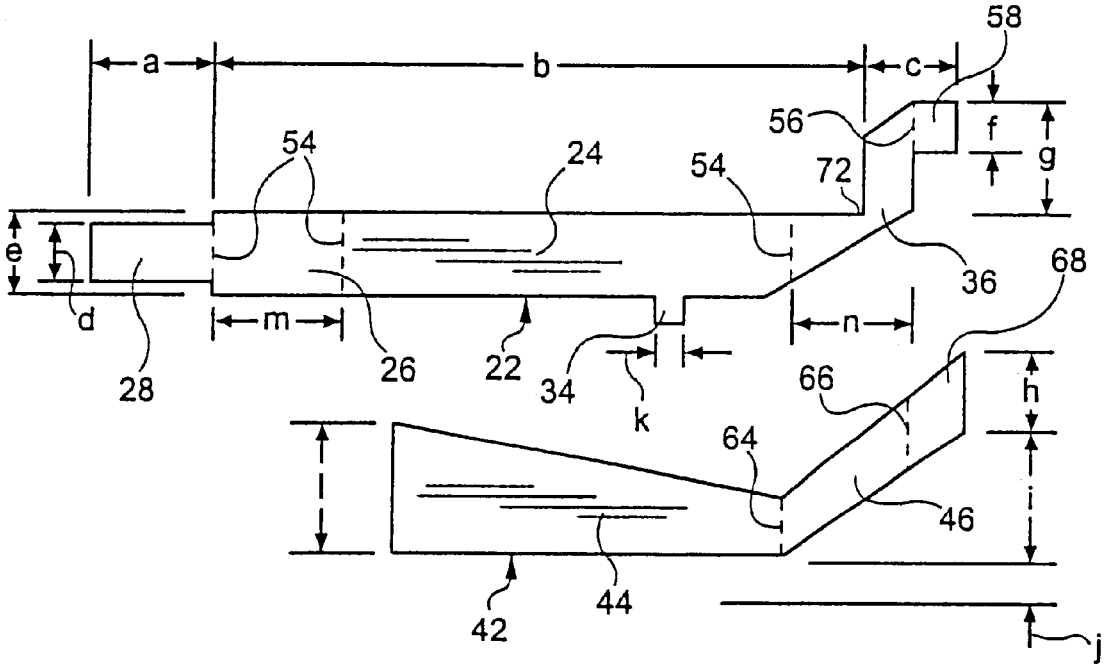
FIG. 5 is a plan view of another embodiment of the first and second conducting elements of the antenna assembly of the present invention prior to forming and attaching onto the ground plane of a printed wiring board.

FIG. 5, in conjunction with Table 1, discloses dimensions for a preferred embodiment of the antenna assembly of the present invention. This figure depicts the conducting elements 22, 42 as they may appear during the process of formation by stamping, after initial separation from a blank of material such as brass, but prior to the steps of bending the leg elements and the foot to the desired orientations, and attaching the conducting elements to the printed wiring board. A variety of other conductive materials may be utilized to form the conducting elements 22, 42, including but not limited to, sheet metal elements, plated plastic or dielectric elements, selectively etched structures, etc. Here, the angled leg elements 36, 46 can be readily discerned. After the conducting element 22, 42 have been separated from a sheet of material, they are formed to the desired shape by manipulation along bend lines 54, 56, 64 and 66. Note that the end portions 58, 68 formed at the end of leg elements 36, 46 may be manipulated along bend lines 56, 66, respectively, to form feet which are attached to the ground plane or they may be left alone and the end elements are attached to the edge of the printed wiring board in a conventional manner (not shown). Although the preferred material used in the conducting elements is patterned brass having a thickness of around 0.020 inch, it will be appreciated that other materials may be used. Although the preferred method of fabrication is a single piece metal stamping adaptable to high volume production, it is understood that other methods of fabrication may be used, including but not limited to injection molding over conductive surfaces, etc.

Particular dimension for the embodiment of FIG. 5 according to the present invention are included as Table 1.

TABLE 1

| Dimension | Inch |
|---|---|
| a | 0.263 |
| b | 1.575 |
| c | 0.240 |
| d | 0.125 |
| e | 0.200 |
| f | 0.120 |
| g | 0.245 |
| h | 0.195 |
| I | 0.278 |
| j | 0.102 |
| k | 0.067 |
| l | 0.255 |
| m | 0.340 |
| n | 0.411 |

Generally, it should be noted that the antenna assembly as depicted in the preferred embodiments is for a right hand circularly polarized global positioning satellite (GPS) operating at a frequency of 1575.42 MHz, with overall dimensions of 1.14 inches in length, by 0.79 inches in width, and 0.45 inches in height. As mounted on a corner of a printed wiring board (PWB), the antenna assembly yields a right hand circular polarization with hemispherical coverage and an axial ration of 2.5 dB at the zenith.

Figure 6:
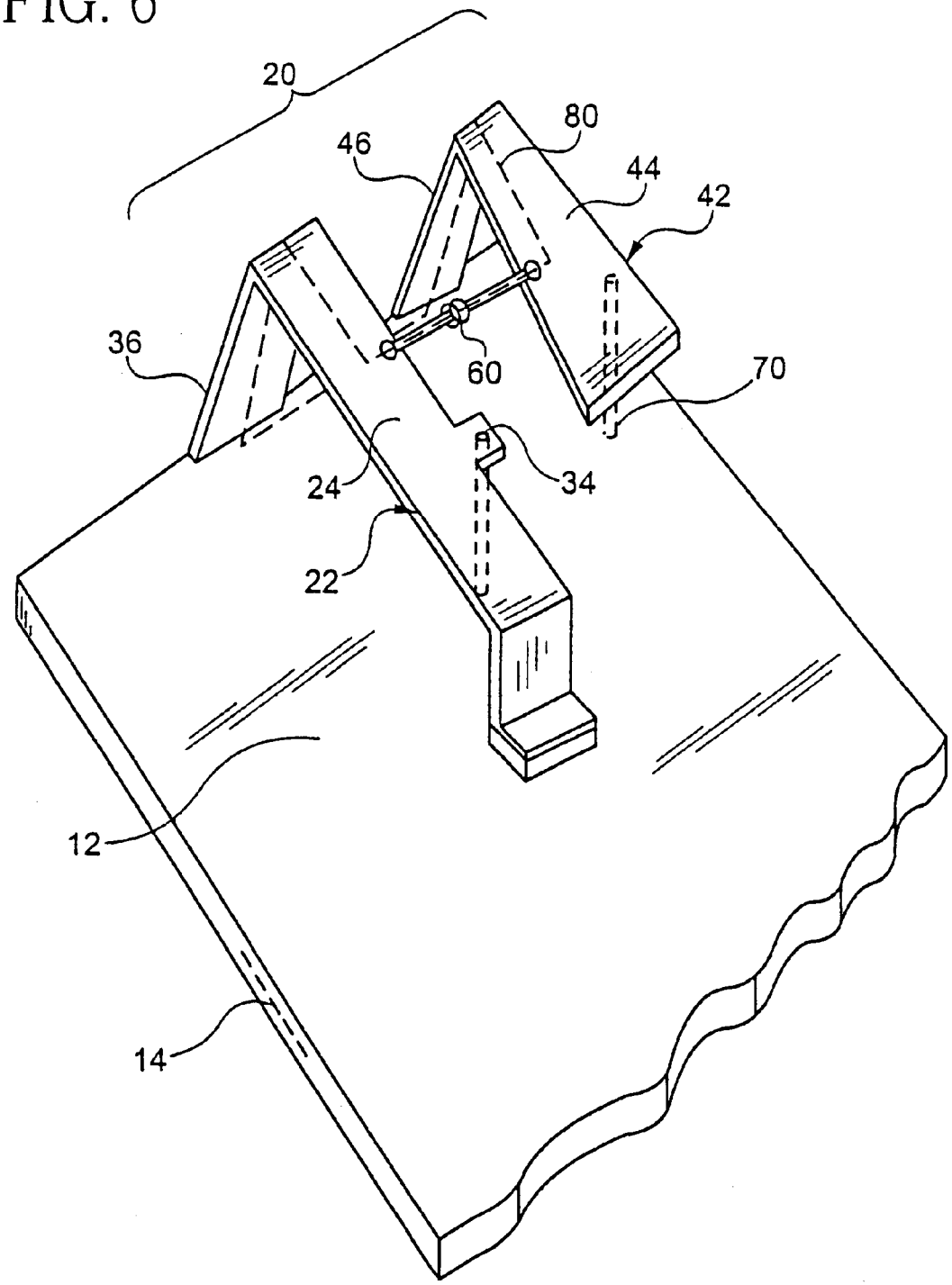
FIG. 6 is a fragmentary perspective view of the antenna assembly of the present invention illustrating a first magnetic dipole element; and, FIG. 7 is a fragmentary perspective view of the antenna assembly of the present invention illustrating a second magnetic dipole element.
Figure 7:
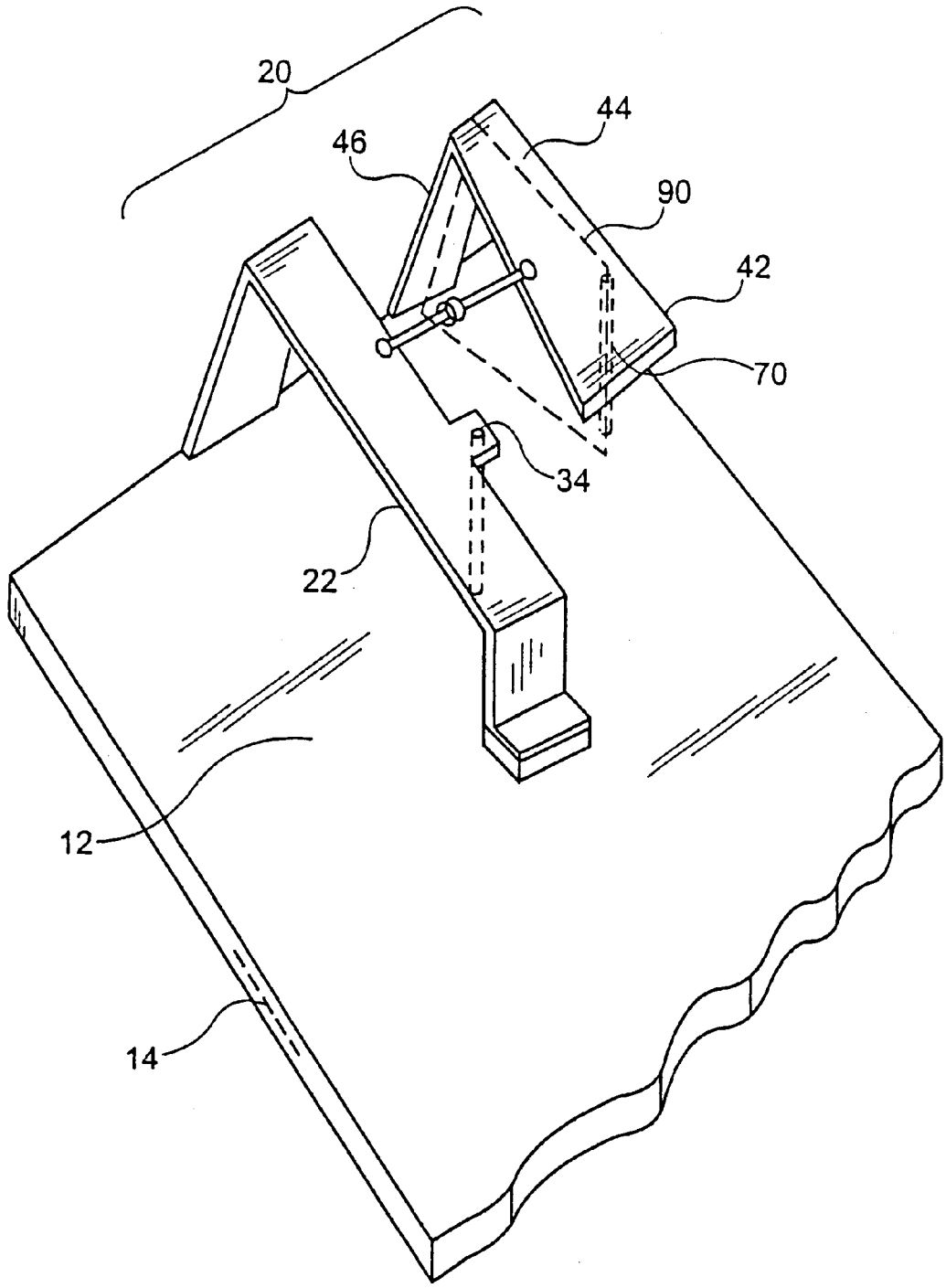

FIGS. 6 and 7 illustrate the first and second magnetic dipole elements 80, 90 that are formed as part of the antenna assembly. In FIG. 6, the first magnetic dipole element 80 is depicted as a dashed line which follows a circuit defined by the first conductive surface 24 and the second leg element 36 of the first conducting element 22, the ground plane 14 of the printed wiring board 12, the leg element 46 and the second conductive surface 44 of the second conducting element 42, and the bridge capacitor 60. The first magnetic dipole element 80 thus formed defines two substantially orthogonally oriented planes.

In FIG. 7, the second magnetic dipole element 90 is depicted as a dashed line which follows a circuit defined by the second conductive surface 44 and the leg element 46 of the second conducting element, the ground plane 14 of the printed wiring board 12, and the conducting member 70. The second magnetic dipole element 90 thus formed defines a third plane which is substantially orthogonal to the planes of the first magnetic dipole element 80.

Additional advantages and modifications will readily occur to those skilled in the art.

The invention in its broader aspects is, therefore, not limited to the specific details, representative apparatus and illustrative examples shown and described. Accordingly, departures from such details may be made without departing from the spirit or scope of the applicant's general inventive concept.

What is claimed:

1. An antenna assembly for use in a wireless communications device, the antenna assembly comprising:

a ground plane element disposed upon a printed wiring board;

a first conducting element having a conductive surface with a feed point, a first leg element and a second leg element, said conductive surface being disposed away from the ground plane element to define an interior region, wherein the first conducting element is capacitively coupled to the ground plane by its first leg element and operatively connected to the ground plane by its second leg element;

a second conducting element having a conductive surface and a leg element, said second conducting element being operatively connected to the ground plane by its leg element, said second conducting element being operatively connected to the ground plane at a second location away from the leg element; and a capacitor element capacitively coupling the first conducting element to the second conducting element.

2. The antenna assembly of claim 1, wherein the first and second conductive surfaces are in substantial alignment with each other.

3. The antenna assembly of claim 2, wherein the first and second conductive surfaces are substantially parallel to the ground plane.

4. The antenna assembly of claim 1, wherein said capacitor element is tunable.

5. The antenna assembly of claim 1, wherein the first conductive surface is defined as a substantially rectangular shape.

6. The antenna assembly of claim 1, wherein the second conductive surface is a polygon.

7. The antenna assembly of claim 6, wherein the polygon is a trapezoid.

8. The antenna assembly of claim 1, wherein the first leg element of the first conducting element is orthogonally arranged with respect to the conductive surface of the first conducting element and wherein the second leg element is skewed with respect said conductive surface.

9. The antenna assembly of claim 8, wherein the leg element of the second conducting element is skewed with respect to its conductive surface.

10. The antenna assembly of claim 1, wherein the first and second conductive surfaces are angled with respect to the ground plane.

11. A wireless communications device comprising:

a printed wiring board including a ground plane element and an RF signal port;

a first conducting element having a conductive surface with a feed point, a first leg element and a second leg element, said feed point being intermediate the first and second leg elements, said feed point being operatively coupled to the RF signal port via a conductor, said conductive surface being disposed away from the ground plane element to define an interior region, wherein the first conducting element is capacitively coupled to the ground plane by its first leg element and operatively connected to the ground plane by its second leg element;

a second conducting element having a conductive surface and a leg element, said second conducting element being operatively connected to ground plane by its leg element, said second conducting element being operatively connected to the ground plane at a second location away from the leg element; and a capacitor element capacitively coupling the first conducting element to the second conducting element.

12. The wireless communications device of claim 11, wherein the first and second conductive surfaces are in substantial alignment with each other.

13. The wireless communications device of claim 12, wherein the first and second conductive surfaces are substantially parallel to the ground plane.

14. The wireless communications device of claim 11, wherein said capacitor element is tunable.

15. The wireless communications device of claim 11, wherein the first conductive surface is defined as a substantially rectangular shape.

16. The wireless communications device of claim 11, wherein the second conductive surface is a polygon.

17. The wireless communications device of claim 16, wherein the polygon is a trapezoid.

18. The wireless communications device of claim 11, wherein the first leg element of the first conducting element is orthogonally arranged with respect to the conductive surface of the first conducting element and wherein the second leg element is skewed with respect said conductive surface.

19. The wireless communications device of claim 18, wherein the leg element of the second conducting element is skewed with respect to its conductive surface.

20. The wireless communications device of claim 11, wherein the first and second conductive surfaces are angled with respect to the ground plane.

21. An antenna assembly for use in a wireless communications device, the antenna assembly comprising:

a ground plane element disposed upon a printed wiring board;

a first conducting element having a conductive surface with a feed point, a first leg element and a second leg element, said conductive surface being disposed away from the ground plane element to define an interior region, wherein the first conducting element is capacitively coupled to the ground plane by its first leg element and operatively connected to the ground plane by its second leg element;

a second conducting element having a conductive surface and a leg element, said second conducting element being operatively connected to ground plane by its leg element, said second conducting element being conductively coupled to the ground plane at a location upon its conductive surface; and a capacitor element capacitively coupling the first conducting element to the second conducting element.

22. An antenna assembly of claim 21, wherein the first and second conductive surfaces are substantially parallel to the ground plane.

23. The wireless communications device of claim 21, wherein said capacitor element is tunable.

24. The wireless communications device of claim 21, wherein the first leg element of the first conducting element is orthogonally arranged with respect to the conductive surface of the first conducting element and wherein the second leg element is skewed with respect said conductive surface.

25. The wireless communications device of claim 24, wherein the leg element of the second conducting element is skewed with respect to its conductive surface.

26. The wireless communications device of claim 25, wherein the first and second conductive surfaces are angled with respect to the ground plane.

* * * * *